US007057574B2

(12) United States Patent
Shamir et al.

(10) Patent No.: US 7,057,574 B2
(45) Date of Patent: Jun. 6, 2006

(54) METHOD FOR DESIGNING A SMALL ANTENNA MATCHED TO AN INPUT IMPEDANCE, AND SMALL ANTENNAS DESIGNED ACCORDING TO THE METHOD

(75) Inventors: Adi Shamir, Yehud (IL); Meir Gazit, Ashkelon (IL)

(73) Assignee: Vishay Advanced Technology Ltd., Or Yehuda (IL)

( * ) Notice: Subject to any disclaimer, the term of this patent is extended or adjusted under 35 U.S.C. 154(b) by 367 days.

(21) Appl. No.: 10/478,234

(22) PCT Filed: Oct. 9, 2001

(86) PCT No.: PCT/US01/31491

§ 371 (c)(1),
(2), (4) Date: Nov. 20, 2003

(87) PCT Pub. No.: WO02/095870

PCT Pub. Date: Nov. 28, 2002

(65) Prior Publication Data

US 2004/0135726 A1 Jul. 15, 2004

Related U.S. Application Data

(60) Provisional application No. 60/292,938, filed on May 24, 2001.

(51) Int. Cl.
*H01Q 7/00* (2006.01)

(52) U.S. Cl. ..... 343/866; 343/748; 343/749

(58) Field of Classification Search ..... 343/700 MS, 343/702, 745, 748, 749, 850, 866
See application file for complete search history.

(56) References Cited

U.S. PATENT DOCUMENTS 3,918,062 A * 11/1975 Haruki et al. ..... 343/702
4,328,501 A * 5/1982 DeSantis et al. ..... 343/749
4,443,803 A * 4/1984 DeSantis et al. ..... 343/749
6,028,564 A * 2/2000 Duan et al. ..... 343/818

OTHER PUBLICATIONS 5.4 Circular Loop with Nonuniform Current—Fig 5.11 Input impedance of circular loop antennas; "Impendance of Thin—Wire Loop Antennas" AIEE Trans vol. 75 Nov. 1956 IEEE.

* cited by examiner

*Primary Examiner*—Hoang V. Nguyen
(74) *Attorney, Agent, or Firm*—Mark M. Friedman

(57) ABSTRACT

A method for designing a high performance, small antenna that is matched to a required output impedance, does not require filtering, is simple and inexpensive to manufacture, and is easily integrable with an RF power amplifier- with minimum cost, minimum external components and minimum energy losses. The method includes finding a singular point (102) in the impedance vs. antenna geometrical dimension/wavelength ratio graph, the singular point (102) exhibiting a high very high positive reactance, setting the antenna geometry to match this point, and canceling the very high positive reactance (high inductance) resulting from this match by adding to the antenna a very small capacitance, preferably provided by at least one gap capacitor (202) The antenna is preferably a loop antenna (200), and both the antenna and the gap capacitor (202) (204) are preferably implemented by printing methods on printed circuit board or ceramic substrates. The antenna (200) may also be implemented in non-differential designs.

24 Claims, 9 Drawing Sheets

(a) Resistance

METHOD FOR DESIGNING A SMALL ANTENNA MATCHED TO AN INPUT IMPEDANCE, AND SMALL ANTENNAS DESIGNED ACCORDING TO THE METHOD

This application claims benefit of Ser. No. 60/292,938 filed May 24, 2001.

FIELD AND BACKGROUND OF THE INVENTION

The present invention relates to antennas, specifically small printed antennas for low cost, short range wireless applications, for example in wireless toys, Wireless keyboards, wireless security systems, RF based remote controllers for TV sets, etc. At present, the relevant industry faces some major difficulties, particularly regarding: 1) miniaturization of antennas without a significant impact on performance; 2) lowering the cost of antennas and of antenna integration in the system; 3) the need for a low-loss filter attached to the antenna as part of the front-end rejection of out-of-band signals; and 4) the need for a low loss impedance matching network that will also maintain a stable matching, with minimal effect of production tolerances and/or of near human presence.

A traditional loop antenna is usually made to resonate when its physical length equals the electrical wavelength of the signal it receives or transmits. In the description below, a "loop" refers to any closed curve ending in a differential transmision line port. For applications that wish to use such an antenna, this puts a major limit on size and form factor. For example, a typical 2.4 Ghz antenna is about 12.5 cm in circumference, which is simply too large for many applications, for example for remote controllers, which require a smaller antenna. Reduction of antenna size in such applications is commonly done by dielectric loading. For example, the antenna can be embedded between layers of a ceramic substrate that has a high dielectric constant. As a consequence, the effective dielectric constant increases, which decreases the effective wavelength of the electrical signal at the antenna, and therefore decreases its size. However, dielectric loading significantly decreases antenna gain, as major parts of the transmitted or received energy dissipate in the dielectric material. This usually deviates the radiation pattern, and is also considered relatively expensive.

Various other methods to decrease the size of the antenna usually result in complicated and expensive matching networks. These methods usually use standard discrete matching components (capacitors, inductors), which have effects unwanted (such dominate especially in high frequencies, when the component dimensions become large with respect to the antenna dimensions or wavelength). In many cases, a lot of energy is wasted on these components, so the antenna gain is decreased. Such components usually have production tolerances. That means, for example, that they cannot be used to create a narrow-band antenna—as the central frequency of the impedance matching will vary from one device to another.

The issue of filtering is also very important. The short range, wireless applications industry usually requires filtering at the antenna port, to protect the system from interfering signals, and to prevent radiation of out-of-band signals, in order to comply with electromagnetic compatibility regulations, such as FCC regulations in the USA. Therefore, expensive filters are installed at the antenna port. Common filters usually suffer from 'insertion loss', which means that they also block some of the energy that is within the required frequency band.

Integration of the antenna with an RF amplifier also raises several problems. RF chips usually show a high output impedance, in order to have a low current consumption. Most antennas in the market today, are built to match the traditional 50 ohm impedance, which again, requires use of another lossy and expensive matching network in between. In addition, a balanced interface also improves the power efficiency of RF chips, so many chip manufacturers today design chips that have a balanced (differential) RF port. As most antennas in the market today are created unbalanced, which means that they are fed with a non-differential transmission line such as a microstrip line, a "balun" component is required at the antenna chip interface, which also adds to the cost and to the energy losses.

Another difficulty that exists, is the fact that human presence near the antenna affects the performance of the antenna. That is due to the fact that the high dielectric constant of the human tissue 'absorbs' the electric fields that are produced by the antenna. An alternative way to describe it is to say that the human tissue behaves as a load that is coupled to the antenna and therefore changes the input impedance that is measured at the antenna port. Since many applications today are 'hand-held' applications, there are major difficulties to maintain a matching to the antenna that is not affected by the human presence. This, sometimes, forces radio designers to increase transmission power by several orders of magnitude (as happens in portable phones).

There is thus a widely recognized need for, and it would be highly advantageous to have, a high performance small antenna that is matched to a required output impedance, does not require filtering, is simple and inexpensive to manufacture, and is easily integrable to an RF power amplifier—with minimum cost, minimum external components and minimum energy losses. The present invention overcomes all the difficulties listed above, and provides these advantages by a novel method to design antennas, with examples showing antennas designed using this method.

SUMMARY OF THE INVENTION

The present invention discloses an innovative, high performance, small area, matched antenna for transmitting and receiving RF signals in an extremely narrow bandwidth. More specifically, the antenna of the present invention is connected to an element that provides a very small capacitance, typically on the order of a few femtofarads to a few tens of femtofarads, the capacitance obtained preferably by a printed gap. The antenna is impedance-matched to a desired output impedance, does not require additional filtering, and can be manufactured easily and inexpensively. The antenna of the present invention can be used for (or in) RF transceivers for video, radio or any other type of data transmission; RF modules integrated in wireless applications such as input and control devices (like remote controllers for TV sets, wireless keyboards etc.); toys and games (wireless game pads, hand held games); home automation and security applications (like wireless light switches, wireless sensors for burglary alarm systems); wireless sensors for industrial automation; portable phones; wireless modems, etc.

According to the present invention there is provided a method for designing a small antenna matched to a required input impedance and operating at a desired frequency, the impedance having a real part and an imaginary part, the method comprising: a) choosing an impedance matching point related to a singular point; and b) canceling the imaginary part of the input impedance, thereby obtaining a design of an antenna matched to the required impedance and operating at a desired frequency.

According to the present invention there is provided a method for obtaining a small loop antenna having geometrical dimensions designed to work at a required frequency and matched to a required input impedance, the method comprising: a) obtaining an optimal design based on matching a singular point defined by the input impedance and by a correlation between the geometrical dimensions and the required frequency; and b) implementing the design.

According to the present invention there is provided a small antenna matched to an input impedance, the input impedance having a very high positive reactance before the matching, the antenna designed to work at a desired frequency, the antenna comprising: a) an antenna element having geometrical dimensions related to the frequency, the relationship correlated with the very high positive reactance; and b) a capacitance added to the antenna element, the capacitance canceling the very high positive reactance, whereby the antenna is matched to the input impedance and operates in a very narrow frequency band.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1A:
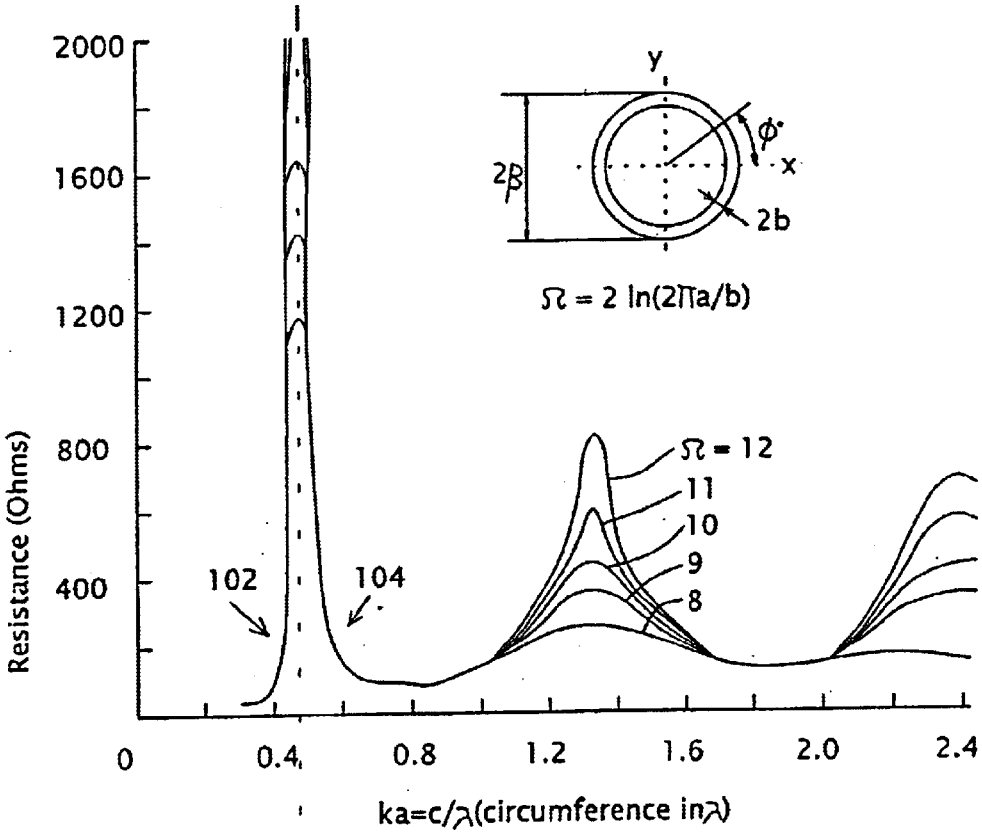
FIG. 1 is a description of the behavior of the impedance of a loop antenna.

The present invention is of a high performance, narrow bandwidth, impedance matched small antenna for short-range wireless applications. Specifically the antenna of the present applications is matched to the desired input impedance by choosing a special singular point. The matching is obtained by using a very small capacitance that is provided by an element which is serially connected to the antenna feeding port aid is an integral part of the antenna, such an element being preferably a printed gap.

As mentioned above, it is possible to overcome the present difficulties faced by antenna industry or RF module designers, by a unique and elegant technique, which is the essence of this invention. Generally, the design procedure starts by choosing to match the antenna in a singular region of its input impedance. A singular region is an interval in which the input impedance, both its real and its imaginary parts, have high derivatives with respect to the geometrical dimensions of the antenna. An example is the region around peak 100 in FIG. 1(*a*), and its correspondent region 100' in FIG. 1(*b*). In this description, the term "geometrical dimensions" refers not only to such features as loop length or circumference or metal line length, but also to substrate properties such as width and thickness, antenna line width or thickness, metal type, or a combination of any of the features above. Since the geometrical dimensions are related to the frequency modes that exist in the antenna, the derivatives will also be high with respect to the frequency. At this singular interval (region around peak 100 in FIG. 1(*a*)), the real part of the impedance rises dramatically and covers a large range of values in a relatively small geometrical change, or frequency change. The matching point will be chosen to be the one that reflects the real value of the impedance to which we wish to match the antenna. There are two such points at the singular region (the real part of the impedance rises and falls): a point with very high positive reactance (high positive imaginary impedance) and a point with very low negative reactance. We must choose for our matching the first point. As a high positive reactance is practically a high inductance, matching to the desired real impedance value is obtained by canceling the high inductance; using a very small serial capacitance that will resonate with it.

Calculating the input impedance of the antenna and identifying the matching point can be done analytically for simple structures (such as simple loops). However, for more complex shapes it can only be done using electromagnetic simulation tools, such as ones that use the Method of Moments electromagnetic solving algorithm, or the FDTD algorithm. These simulation tools will receive as an input a physical model of the antenna, including the electromagnetic characteristics of the metal and substrate materials, and produce a graph showing the dependence of the input impedance of the antenna on frequency or any of the geometrical parameters.

The principles and operation of an impedance matched antenna to a singular point using a resonating element, preferably a printed gap, according to the present invention may be better understood with reference to the drawings and the accompanying description.

Figure 1B:
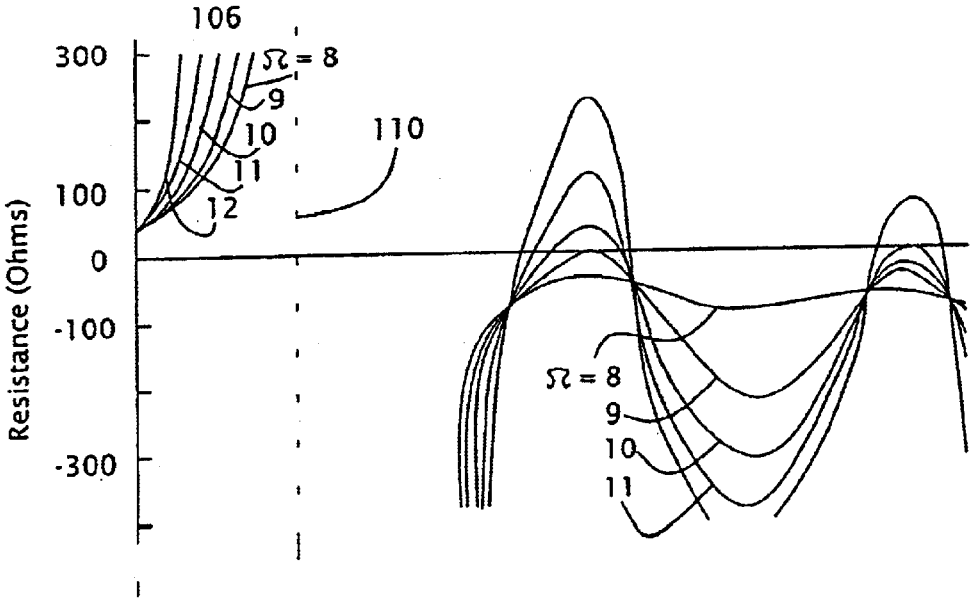

By way of example only, the following demonstrates a preferred way of finding a singular point. The behavior of the impedance of a loop antenna is demonstrated in FIG. 1 [Balanis C. A., "Antenna theory, analysis and design", John Wiley & Sons Inc, second edition, 1997, page 227]. The two graphs in FIG. 1 present the loop input impedance (both real (a) and imaginary (b) parts) vs. the ratio between its physical circumference (length) and the wavelength (which is correlated with the working frequency) of the signal it carries. When the loop length decreases to around half the wavelength, the resistance (the real part of input impedance) increases dramatically. The reactance behaves as very large inductance (high positive reactance) when the loop length/wavelength ratio $C/\lambda$ is below the one at the resistance peak 100, and as a very small capacitance (negative reactance) when the loop length/wavelength ratio is just above the one at the resistance peak. Therefore, in this specific example, the singular point is found when the loop length is around 0.5 of the wavelength ($C/\lambda=0.5$). In general, the singular point for a loop will be found at a length that is a fraction, smaller than one, and more typically between about 0.2 and 0.7 of the wavelength.

It is worthwhile to mention here the fact that choosing this singular point as a starting point, is quite non-obvious, and in fact opposite to present practice in antenna design. In fact, in present practice, designers tend to avoid such singular points because: a) they find it very hard or even impossible to handle them; and b) they do not see the advantages and the potential in using them. The present invention handles this singularity in a unique and elegant approach, which reveals a number of advantages of using the singularity.

Referring now again to the drawings, one can see in FIG. 1(*a*) that the real part of the impedance, in the singular region, ranges from a value of a few ohms to more than 1 kohm. Assume now, for example and without loss of generality, that one wishes to match a small loop antenna to an impedance of 200 ohm. At the singular region, there are two such points where the real part of the impedance is 200 ohms—one at around 0.4 wavelengths at a point 102 on FIG. 1(*a*), and one at around 0.55 wavelengths at a point 104 at FIG. 1(*a*). Positive values of imaginary impedance are given by curves 106 in FIG. 1(*b*), and they increase in value asymptotically from the right to a value represented by a dotted line 110 at $C/\lambda=0.5$. One will therefore, according to the method of the present invention, choose the 0.4 wavelength point (point 102), as at this point the imaginary part of the input impedance is highly positive (reflecting high inductance) as reflected when looking at a point parallel to point 102 on FIG. 1(*b*). In other words, one will calculate the wavelength of the working frequency, and design a loop that is about 0.4 wavelengths long. For example, for a 2.4 Ghz antenna, the wavelength is 12.5 cm, and therefore the loop circumference will be 5 cm. Obviously, in practice, this is a lot more complicated as there are other physical parameters that determine the working point (such as materials, substrate structure for printed antennas, line thickness, etc., or, more generally, any of the "geometrical dimensions" referred to above). Therefore, simulation has to be done in order to determine the exact working point, especially when the geometry is not as simple as a loop.

The first advantage of the design can now be immediately observed: loop antennas are usually one wavelength long, so when one chooses a 0.4 wavelength working point, the area that the antenna takes will be reduced by a factor of 0.4 squared, or in other words by more than six times.

After choosing the working point, one needs, according to the present method of design, to move towards the impedance matching. As at the chosen singular working point, the real part of the impedance is the desired impedance for the matching, one needs, as said before, to eliminate the imaginary part. Since the imaginary part reflects high inductance, eliminating it is preferably done by a serial capacitance that is very small. For example, to eliminate a 2 kohm positive reactance at a frequency of 2.4 Ghz, it is required to connect a serial capacitor or a combination of capacitors with a total capacitance of about 30 ff, which is an extremely small capacitance. Typical capacitances for antennas designed to work in the GHz range and matched to typical impedances of a few tens to a few hundreds of ohms will range from a few femtofarads to a few hundreds of femtofarads. In addition, since the impedance derivatives are so high at the singular working point, the tolerances that are required to maintain a stable point in mass production are extremely high. This is another of the reasons why prior art designs naturally avoid this working point. It is most difficult to reach such low capacitance values using discrete components, and maintain the tight tolerances that are required.

In the method of the present invention, the low required capacitance is achieved by using at least one printed gap, which is most applicable to printed antennas. A gap is formed on the antenna strip preferably at its port, and provides the required capacitance. The gap actually becomes an integral part of the antenna, and has to be simulated with the antenna in order to achieve the right accuracy. The capacitance formed by the gap, although extremely low, is not too sensitive when printed circuit board (PCB) manufacturing tolerances are taken into account, and therefore can provide a perfect solution. In addition, the choice of a differential antenna will require capacitance in each pole of the antenna port, so that the capacitance required in each port is double the total capacitance needed for the impedance matching.

Figure 2A:
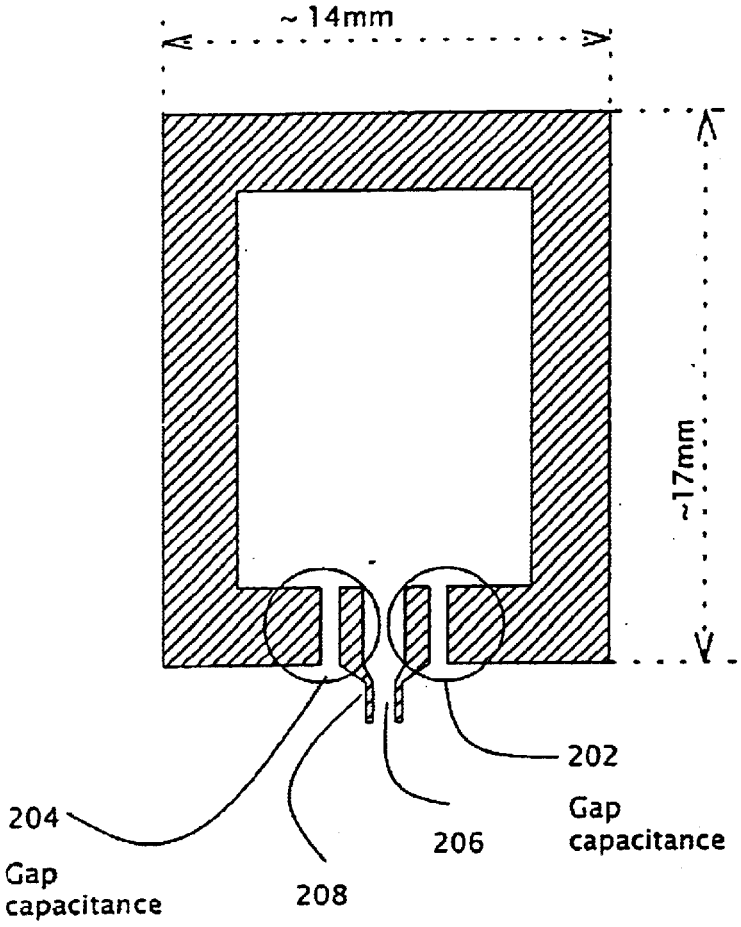
FIG. 2 is an example of a preferred embodiment of an antenna designed with the method of the present invention and of simulation results.
Figure 2B:
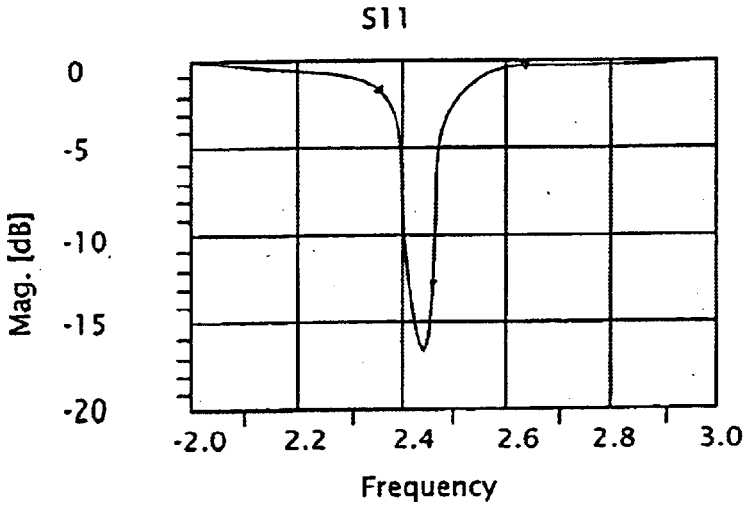

A preferred embodiment of the antenna with a serially connected printed gap of the present invention is shown in FIG. 2(*a*). The design is a square loop antenna 200 for working at 2.44 Ghz, and matched to a differential impedance of 200 ohm. Preferably, the antenna is a microstrip antenna element printed on an FR4 dielectric substrate, which has a relative dielectric constant of 4.4 and a thickness of 0.6 mm. Two gaps 202 and 204 are formed right at an antenna input port 206, parallel to a feed line 208, and provide the required capacitance for the matching. Each gap width is preferably about 0.2 mm. In this embodiment, the antenna size is approximately 14×17 mm. Two gaps are given as an example only, and one or more gaps, as well as any combination of gaps that can provide the required small capacitance for the matching is envisioned as within the scope of the present invention.

FIG. 2 also shows in (b) the absolute magnitude of the reflection coefficient (S11) of this antenna in a db scale, as simulated using a Method of Moments electromagnetic simulation tool, and calculated with respect to a 200-ohm source impedance. The figure shows that the antenna is well matched at the desired frequency. Another important advantage of this antenna is now revealed: the matching is very narrow banded—about 80 mhz, which is about 3% of the working frequency, and defined at the interval between the points where |S11| equals −6 db. This quality turns the antenna into a high Q band-pass filter, which prevents reception or transmission of out-of-band signals. High Q filtering is achieved due to the high impedance derivatives in the singular region in which the antenna is matched, and also due to the fact that the matching mechanism is minimal in energy dissipation.

Figure 3:
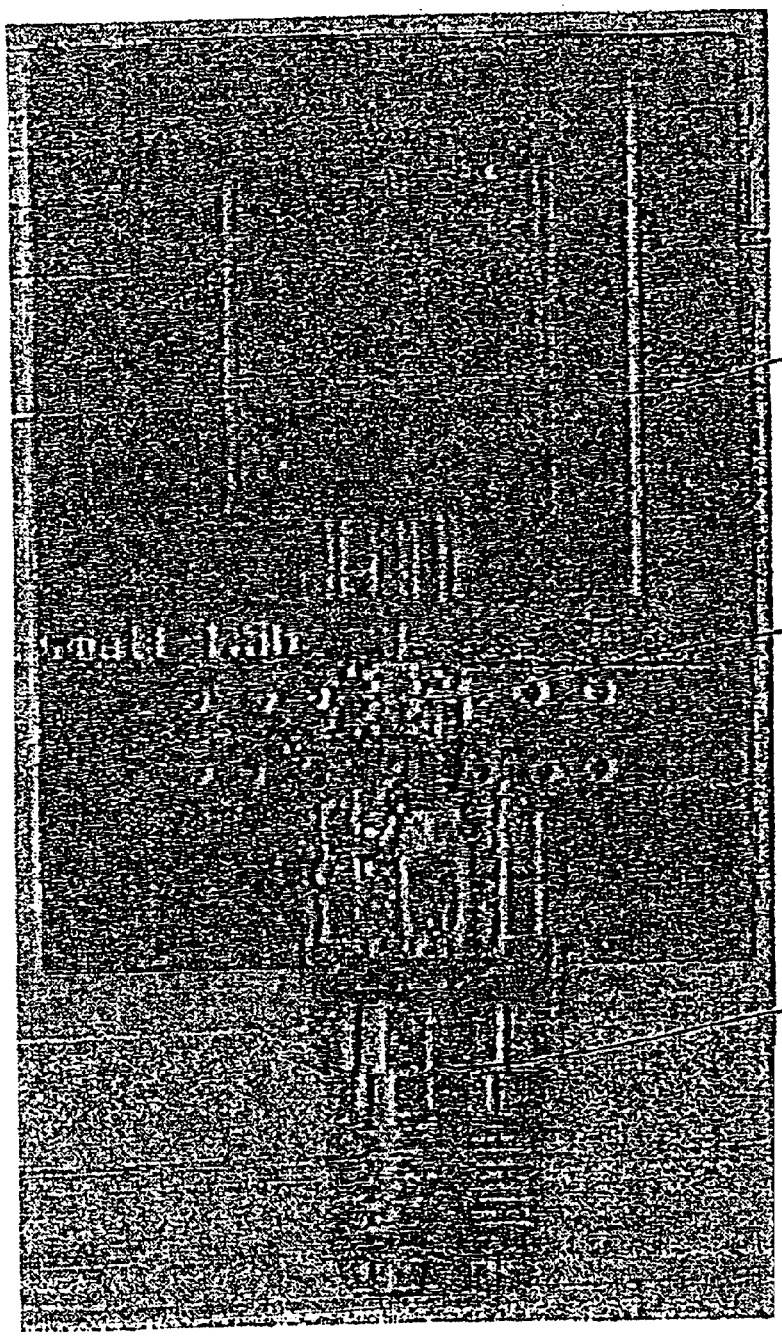
FIG. 3 is a photograph of the antenna of FIG. 2, implemented on a substrate using printing methods.
Figure 4A:
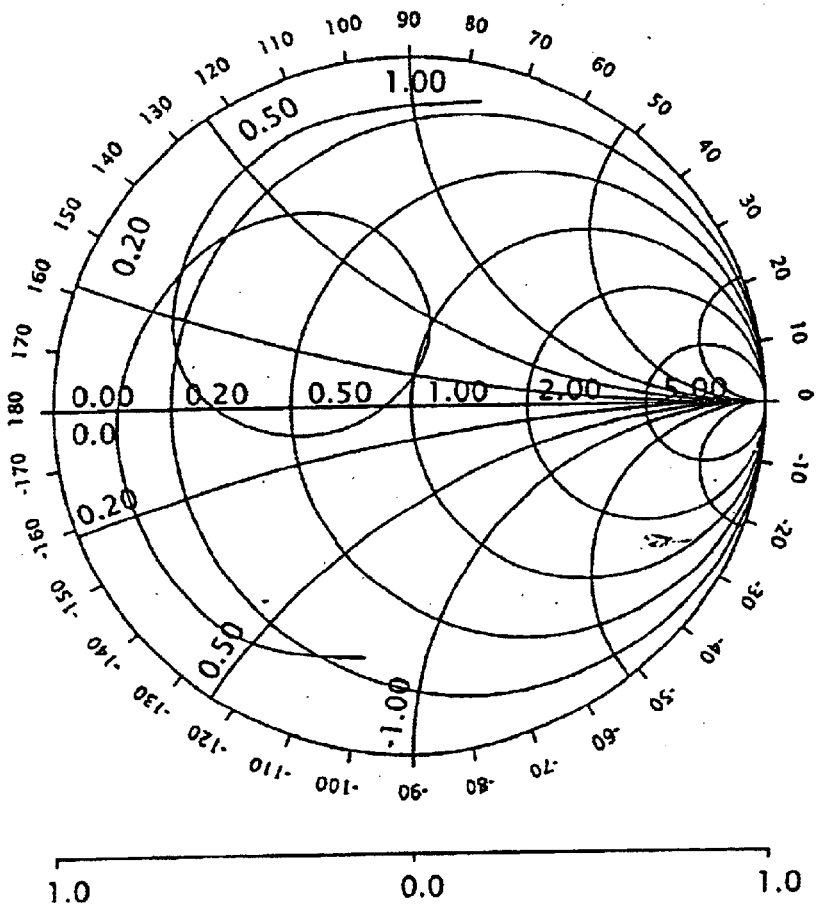
FIG. 4 shows measurement results obtained on the antenna of FIG. 3.
Figure 4B:
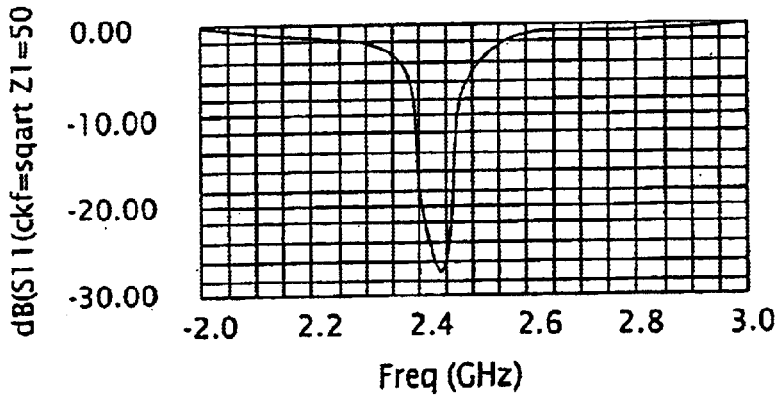

FIG. 3 shows a picture of antenna 200 of FIG. 2, connected to a 50 ohm SMA connector 302 through a 200 Ohm balanced-to-50 ohm-unbalanced 2.4 Ghz "balun" component 304. FIG. 4(*a*) shows the reflection coefficient (S11) of the antenna in polar representation ('Smith Chart') as a function of frequency. The point closest to the center is at 2.44 Ghz, and indicates the required resonance. FIG. 4(*b*) shows the absolute magnitude of the reflection coefficient—|S11| in a logarithmic scale, and the absorption of energy at 2.44 Ghz is clearly seen, so is the narrow band of the absorption. The reflection coefficient was measured using an HP8753 vector network analyzer. The results file was saved and plotted (FIG. 4) using Ansoft Serenade V8.5 software. When comparing FIG. 4(*b*) with FIG. 2(*b*), it is clearly evident that the experimental results match the simulation results. A large quantity of these antennas was manufactured, all exhibiting the same performance. This indicates low sensitivity of the antenna central frequency to production tolerances, despite the singularity of the matching. This repeatability and low sensitivity is directly related to the low sensitivity of the gap capacitance to production tolerances.

Another extraordinary attribute and advantage of the antenna according to the present invention, is the fact that it is almost unaffected by the environment. The matched frequency remains stable, even when a human tissue is present within a very short distance from the antenna. It was shown experimentally, using a reflection coefficient measurement, that for the specific embodiment presented here the central frequency of the antenna remained constant, when the antenna was surrounded by human tissue at a distance of 1 cm from the antenna. This can be explained by the fact that a loop antenna stores its near-field energy in a magnetic field, which is hardly affected by the high dielectric constant of the human tissue, unlike for example dipole antennas, for which the near-field energy is electrical, and the field pattern is very sensitive to human presence. Although this fact is not directly related to the invention, but is a characteristic of loop antennas, the present design method strongly contributes to this advantage by the fact that the matching mechanism is minimal and accurate, and so a narrow band antenna that is not sensitive to human presence can be easily manufactured.

Figure 5:
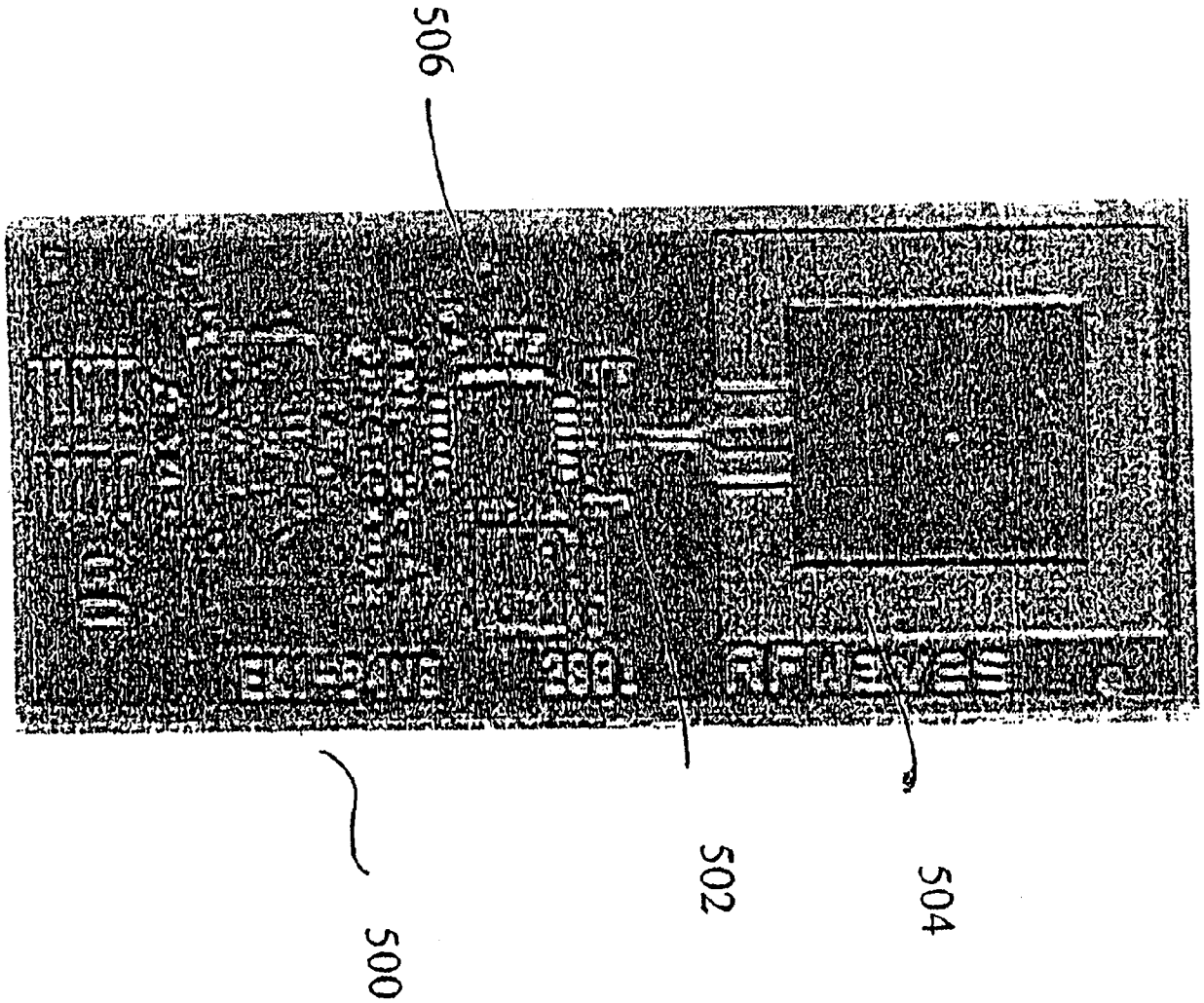
FIG. 5 is a photograph of the printed antenna of FIG. 4 integrated in an RF module.

FIG. 5 shows the antenna of the present invention as part of an RF transceiver 500. Looking at an interface 502 between an antenna structure 504 and an RF chip 506, it is clearly seen that antenna 504 is directly connected to chip. Thus, additional components such as matching components, a filter or a balun component are not required. Therefore, energy dissipation on the path between the chip and the antenna is minimized dramatically, the system becomes more efficient and the antenna gain increases. In addition, production costs and complexities are decreased.

Figure 6A:
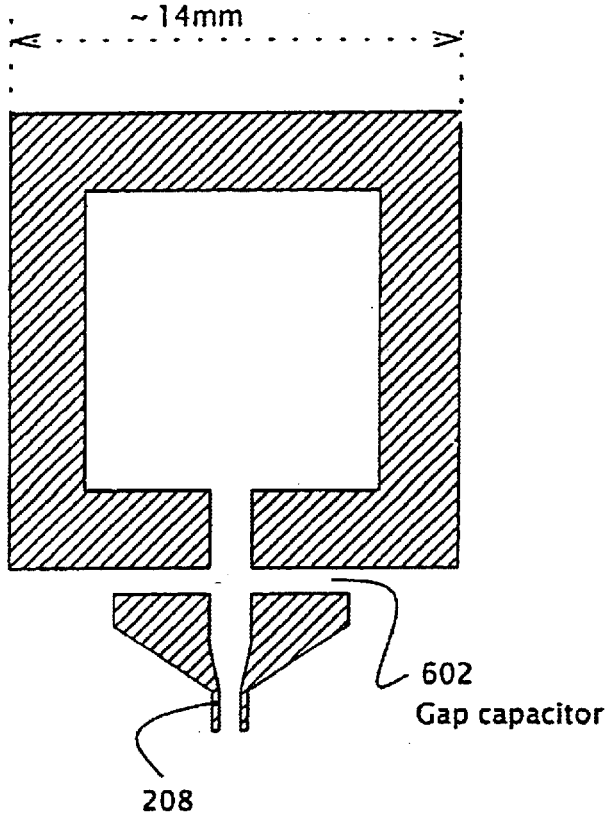
FIG. 6 is another preferred embodiment of an antenna designed with the method of the present invention.
Figure 6B:
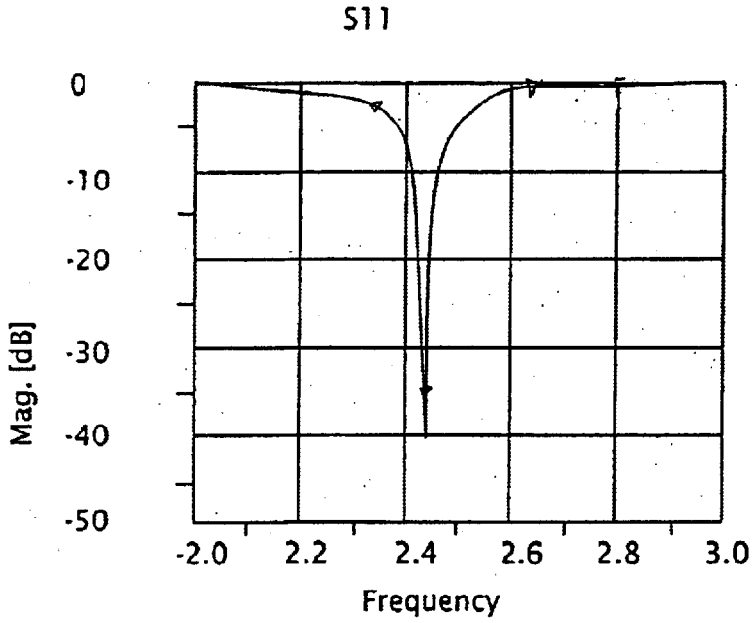
Figure 7A:
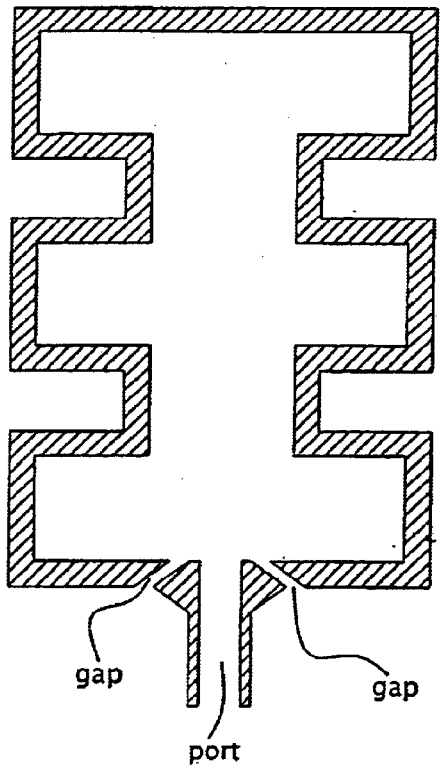
FIG. 7 is a schematic description of various possible geometries of antennas designed with the method of the present invention.
Figure 7B:
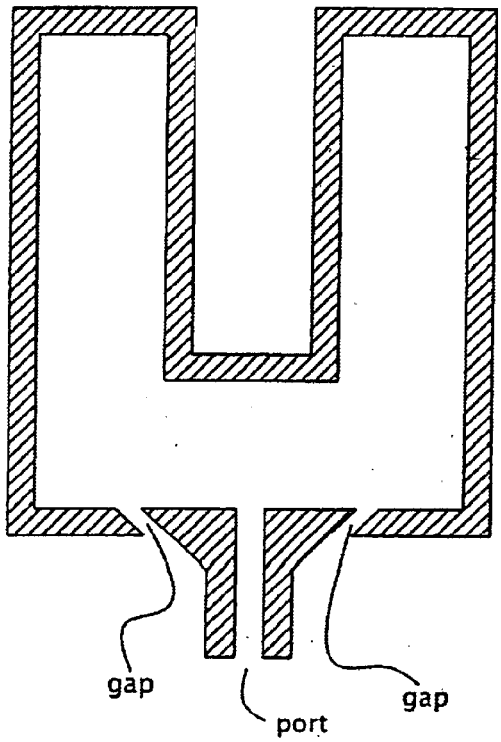
Figure 7C:
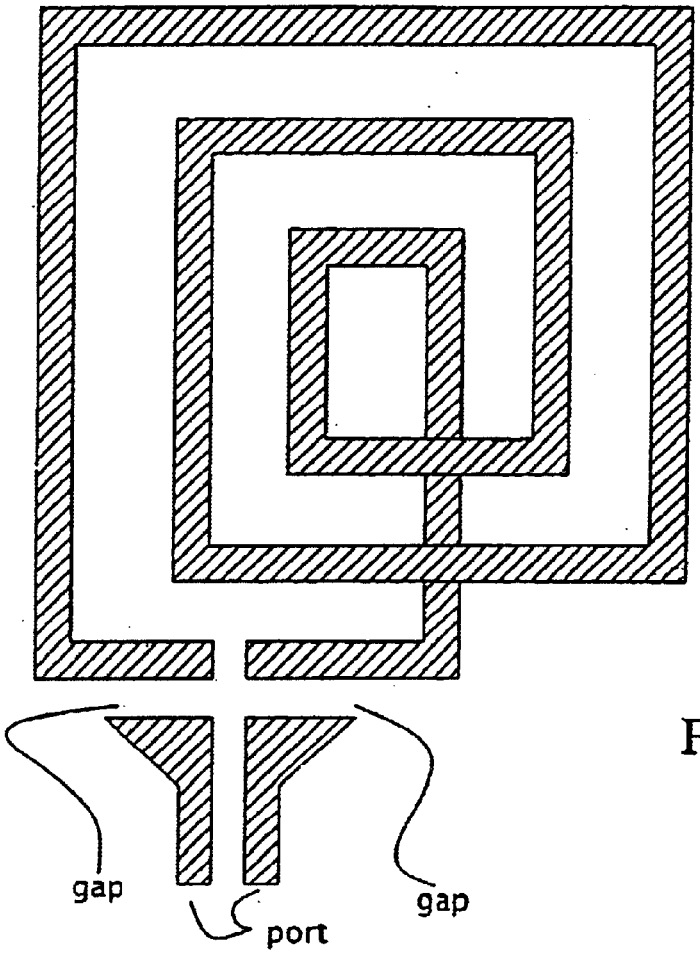
Figure 7D:
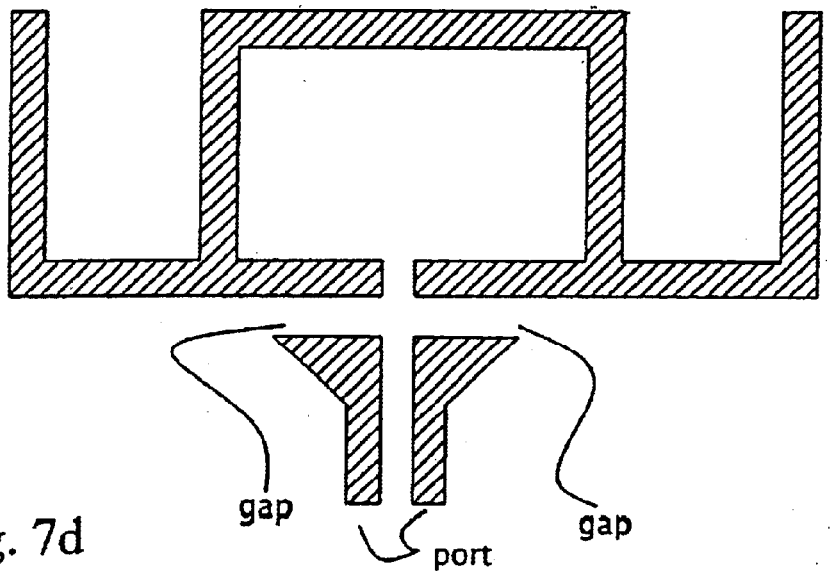
Figure 7E:
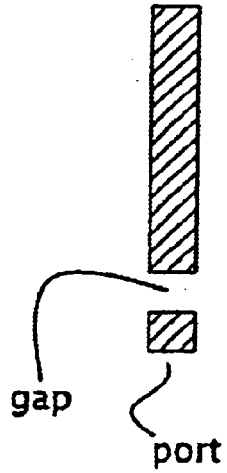
Figure 7F:
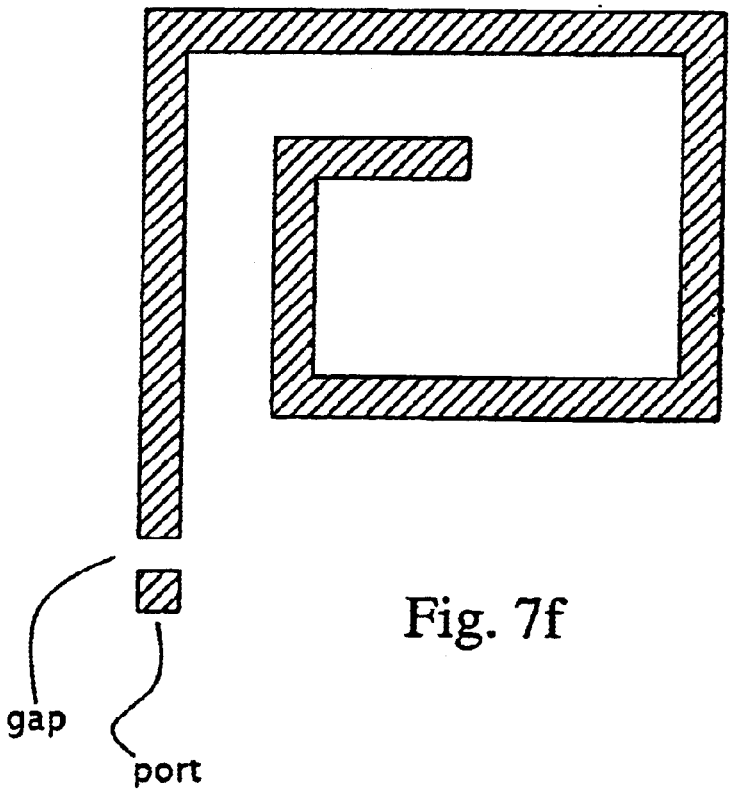

Another preferred embodiment of the antenna of the present invention is shown in FIG. 6. The design is basically similar to that of FIG. 2, but a gap capacitance 602 is this time orthogonal to feed line 208, unlike in FIG. 2 where the gaps are parallel to the feed line. This design is somewhat smaller than that in FIG. 2, and also gives a narrower bandwidth (about 60 Mhz), as appears in the S11 graph in FIG. 6(*b*). This antenna was also manufactured and tested, and the measured results matched the simulated results.

Although the geometries presented above are of a rectangular loop, many other antenna geometries can show the same singular impedance behavior that may fit the principles described above. A round loop is one trivial example, but many other curved shapes or closed geometric shapes, e.g. oval, rectangular, triangular, hexagonal, etc., as well as non-regular shapes can be used. FIG. 7 shows three such non-regular shapes: (a) notched rectangle; (b) fork shaped loop; (c) double layer spiral. More complex shapes, such as a combination of loops, spirals or dipoles that show the same singular behavior, also fall within the scope of the present invention, for example the loop/dipole combination in FIG. 7(*d*). The method is not only applicable to differential ports, and it is possible to find the same singularity in non-differential antennas as well, for example in the monopole and spiral monopole shown in FIGS. 7(*e*) and (*f*) respectively.

In addition, there are many possibilities for the production method. The examples above showed an antenna printed on a one-layer PCB substrate, such as FR4. However, the antenna can also be embedded between two layers of PCB (this will decrease its size, but increase dielectric losses and decrease gain), or be printed on more than one layer (part of the antenna on one layer—and part on another). PCB technology usually uses organic materials such as FR4 or Teflon. It is also possible to use ceramic substrates in HTCC or LTCC (High/Low temperature ceramic co-fire) technologies, and print the antenna on one or more layers of ceramic substrate, or embed the antenna inside a ceramic material. As ceramic materials can have very high dielectric constants, this may decrease the size dramatically on one hand, but will decrease efficiency on the other hand.

Regarding the capacitance provided in the examples described above by a gap in the printed microstrip, it is also possible to achieve it in ceramic technology, when the antenna is embedded or printed on a ceramic substrate. It is also possible to use two or more gaps in series, or any other gap combination that will decrease the capacitance. It is also possible to use discrete capacitors, if they are manufactured with the appropriate tolerances and small values (although this may increase price and energy dissipation). The term "capacitance" is thus used herein to describe any small capacitance that can be achieved by any single capacitor or any combination of capacitors.

All publications mentioned in this specification are herein incorporated in their entirety by reference into the specification, to the same extent as if each individual publication was specifically and individually indicated to be incorporated herein by reference. In addition, citation or identification of any reference in this application shall not be construed as an admission that such reference is available as prior art to the present invention.

While the invention has been described with respect to a limited number of embodiments, it will be appreciated that many variations, modifications and other applications of the invention may be made.

What is claimed is:

1. A method for designing a small antenna matched to a required input impedance and operating at a desired frequency, the impedance having a real part and an imaginary part, the method comprising:

a. choosing an impedance matching point related to a singular point, and b. canceling the imaginary part of the input impedance, thereby obtaining a design of an antenna matched to the required impedance and operating at a desired frequency.

2. The method of claim 1, wherein said impedance match choosing step includes setting at least one geometrical dimension of said antenna in a mathematical relationship with said desired operating frequency.

3. The method of claim 2, wherein said geometrical dimension is a length, and wherein said setting of said length in a mathematical relationship with said operating frequency includes setting said length to be a fraction smaller than one of a wavelength proportional to said frequency.

4. The method of claim 2, wherein said setting further includes using said relationship between said at least one geometrical dimension and said desired operating frequency to match the required real part of the impedance at said singular point.

5. The method of claim 1, wherein said canceling includes providing a very small series capacitance that resonates with a very high positive value of the imaginary part of the input impedance.

6. The method of claim 5, wherein said providing a very small series capacitance includes providing a gap capacitance.

7. The method of claim 3, wherein said antenna is a loop antenna, and wherein said geometrical dimensions include the length of said loop.

8. The method of claim 2, wherein said antenna is a non-differential antenna.

9. A method for obtaining a small loop antenna having geometrical dimensions designed to work at a required frequency, the loop antenna matched to a required input impedance, the method comprising:

a. obtaining an optimal design based on matching a singular point defined by the input impedance and by a correlation between the geometrical dimensions and the required frequency, and b. implementing said design.

10. The method of claim 9, wherein said matching a singular point is preceded by identifying a singular region in which the real part of the impedance rises, and choosing in said singular region said singular point.

11. The method of claim 10, wherein said choosing of said singular point is based on matching the real part of the impedance, wherein said matching of the real part includes choosing a very high positive reactance.

12. The method of claim 9, wherein said implementing further includes implementing said design on a substrate using printed circuit board techniques.

13. The method of claim 11, wherein said matching to said real part of the impedance further includes canceling said very high positive reactance.

14. The method of claim 13, wherein said canceling is effected by adding a series capacitance to said antenna.

15. The method of claim 14, wherein said adding a series capacitance includes adding a gap capacitor.

16. The method of claim 15, wherein said gap capacitor has a capacitance ranging between a few femtofarads to a few hundreds of femtofarads.

17. A small antenna matched to an input impedance, said input impedance having a very high positive reactance before the matching, the antenna designed to work at a desired frequency, the antenna comprising:

a. an antenna element having at least one geometrical dimension related to the frequency, said relationship correlated with the very high positive reactance, and b. a capacitance added to said antenna element, said capacitance canceling the very high positive reactance, whereby the antenna is matched to the input impedance and operates in a very narrow frequency band.

18. The antenna of claim 17, wherein said capacitor includes at least one gap capacitor having a gap capacitance.

19. The antenna of claim 18, wherein said antenna element and said at least one gap capacitor are printed on a substrate.

20. The antenna of claim 18, wherein said gap capacitance ranges from a few femtofarad to a few hundreds of femtofarads.

21. The antenna of claim 17, wherein said antenna element has a shape chosen from the group consisting of loops, spirals, dipoles and a combination thereof.

22. The antenna of claim 19, wherein said substrate is chosen from the group consisting of a single layer PCB substrate, a double layer PCB substrate, a multi layer PCB substrate, a single layer ceramic substrate, and a multilayer ceramic substrate.

23. The antenna of claim 21, wherein said loop shape is chosen from the group consisting of oval, rectangular, triangular, hexagonal and non-regular geometric shapes.

24. The antenna of claim 23, implemented as a non-differential antenna.

* * * * *